US005412553A

United States Patent [19]

Wojski

[11] Patent Number: 5,412,553

[45] Date of Patent: May 2, 1995

[54] LIGHTED CURTAIN HARDWARE ASSEMBLY FOR WINDOWS

[75] Inventor: Wesley G. Wojski, Mahtomedi, Minn.

[73] Assignee: Studio Soleil, Inc., White Bear Lake, Minn.

[21] Appl. No.: 33,148

[22] Filed: Mar. 16, 1993

[51] Int. Cl.[6] ..... F21V 33/00

[52] U.S. Cl. ..... 362/253; 362/147; 362/432; 362/806

[58] Field of Search ..... 362/147, 151, 249, 252, 362/253, 255, 432, 806, 234, 102, 145; 211/105.1, 123; 248/261, 251; D6/575–580

[56] References Cited

U.S. PATENT DOCUMENTS

| | | | |
|---|---|---|---|
| 714,231 | 11/1902 | Phillips | 362/123 |
| 1,665,704 | 4/1928 | Kernes | 362/145 |
| 2,217,688 | 10/1940 | Larson et al. | 362/73 |
| 2,564,865 | 8/1951 | Turner et al. | 362/151 |
| 2,662,163 | 12/1953 | Mollner | 362/151 |
| 2,681,979 | 6/1954 | Manoloff | 362/102 |
| 2,708,711 | 5/1955 | McGinty et al. | 362/151 |
| 2,827,555 | 3/1958 | Woolley | 211/123 |
| 3,384,741 | 5/1968 | Bice | 362/102 |
| 3,740,541 | 6/1973 | Conradt | 362/234 |

*Primary Examiner*—Ira S. Lazarus
*Assistant Examiner*—Y. Quach
*Attorney, Agent, or Firm*—Palmatier, Sjoquist & Helget

[57] ABSTRACT

A lighted curtain hardware assembly for a wall having an opening therein has a curtain support hardware device. The hardware device is mountable adjacent the opening, such as a window or door, for supporting a curtain in front of and adjacent the opening without visually obstructing the opening. The hardware device has a light mounted thereon. Electrical means are included for providing electricity to the light to provide an attractive lighted decoration to the window or door and adjacent wall.

16 Claims, 4 Drawing Sheets

LIGHTED CURTAIN HARDWARE ASSEMBLY FOR WINDOWS

BACKGROUND OF THE INVENTION

This invention generally relates to wall dressings, and more particularly, to a lighted curtain hardware assembly suitably for a residential window.

Windows in buildings, particularly residences, have been decorated with "soft-look" fabric treatments for many many years. The soft-look typically may include drapery, curtain, traverse and/or valance rods from which downwardly are suspended one or more fabrics or curtains. The curtains are intended to give a fashion or decorative look to the window. Additionally, many such fabric treatments of windows permit the fabric or curtain to be moved on the rods as to block or close viewing through the window.

More recently, windows have been decorated with what may be considered a more "hard-look" fashion design. That is, horizontal and vertical blinds and shades have presented another distinctive decorative treatment of windows which permits a modernistic fashion look as well as permitting the closure of viewing through the window. It has been widely accepted that the hard and soft-look methods of treatment of windows work well independently of each other but do not blend together very well.

There is a desire for a simple soft-look window treatment with perhaps a new design element. The decorator may achieve a greater latitude in window fashions if the new simple design would blend well with the hard-look of blinds or shades. Heretofore lighting has not been utilized with window treatment. It is believed that lighting may be the new element for a simple soft-look window treatment that further may have the additional benefit capability of blending the two decorative window treatments together into an unique window fashion accessory appropriate for residences.

SUMMARY OF THE INVENTION

A lighted curtain hardware assembly for a wall having an opening therein has a curtain support hardware device. The hardware device is mountable adjacent the opening, such as a window or door, for supporting a curtain in front of and adjacent the opening without visually obstructing the opening. The hardware device has a light mounted thereon. Electrical means are included for providing electricity to the light to provide an attractive lighted decoration to the window or door and adjacent wall.

A principal object and advantage of the present invention is that it provides a unique attractive decoration including a luminous effect heretofore not known in window or door fashions.

Another object and advantage of the present invention is that it provides more latitude to the designer in decorating residential windows with combinations of the soft and hard-look.

Another object and advantage of the present invention is that the designer may provide the home with an infinite variety of indirect lighting as the rays are projected through and from ornate decorative glass globes and customized curtain tie backs.

Another object and advantage of the present invention is that it utilizes the household high voltage current, but however, steps down the voltage at the wall socket to greatly enhance personal safety from electrocution and greatly minimizes heat and fire hazards otherwise associated with higher voltage lighting within a residence.

DETAILED SPECIFICATION

Figure 1:
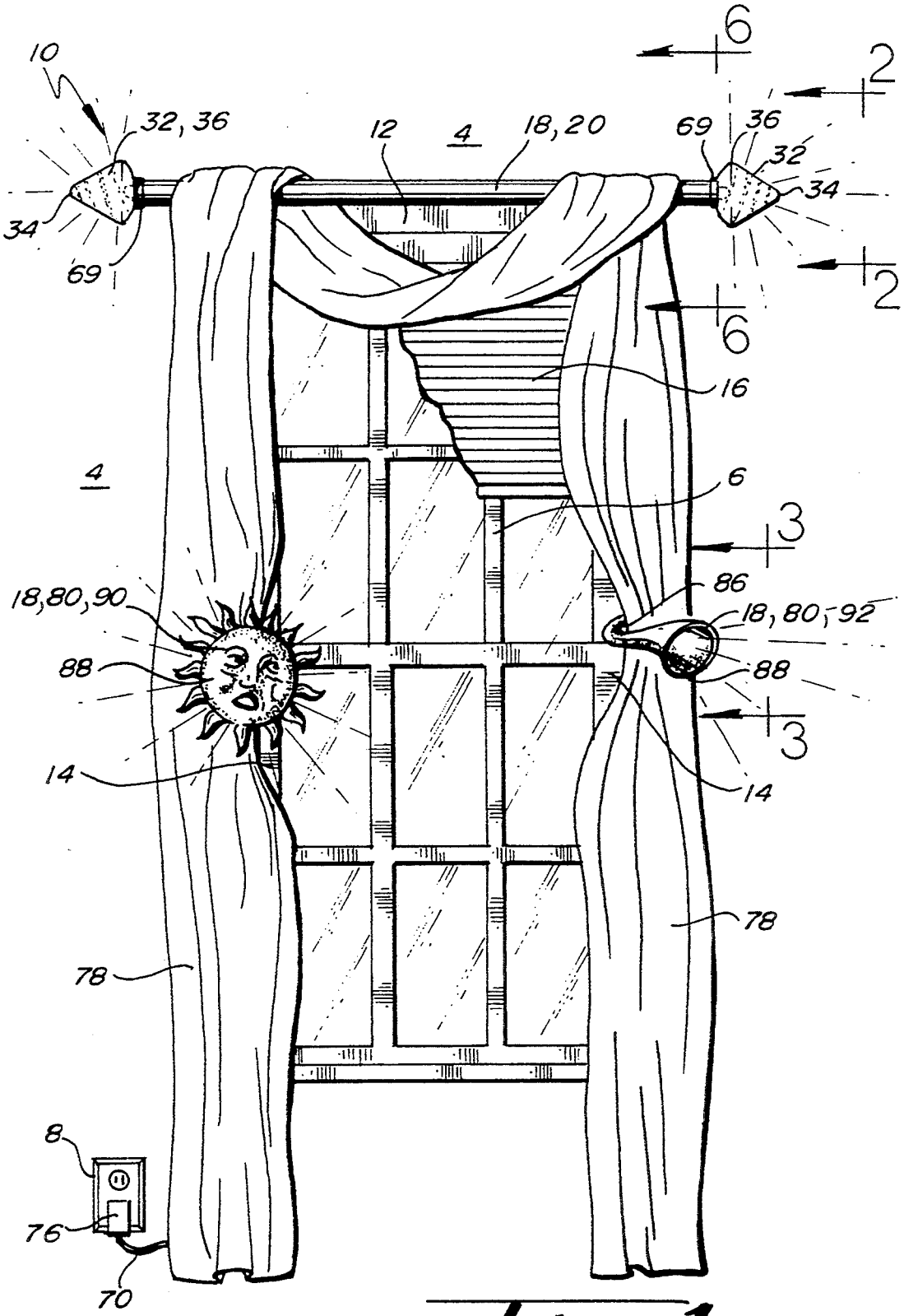
FIG. 1 is a front elevational view of a wall with a window therein and the lighted curtain hardware assembly of the present invention.
Figure 1A:
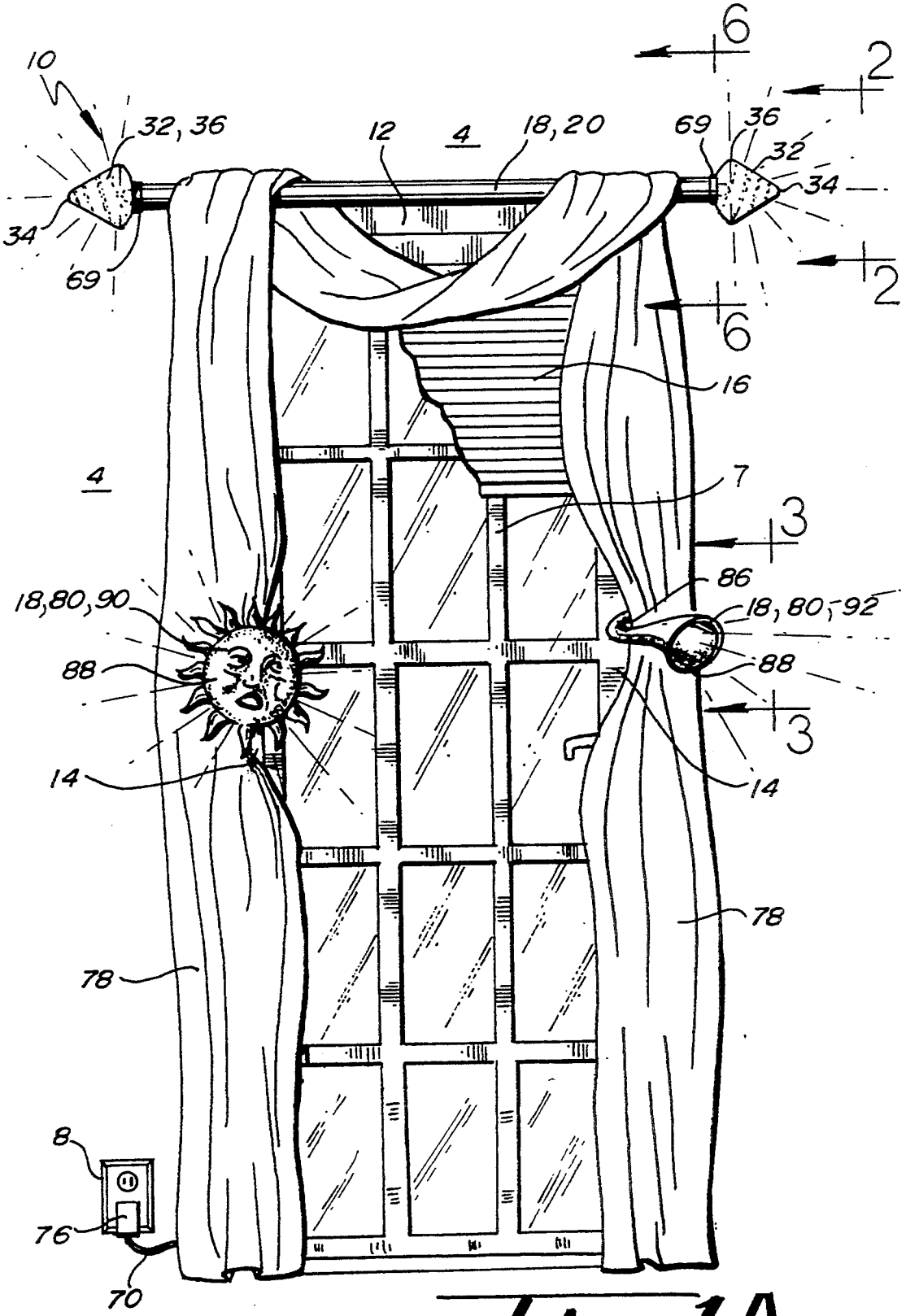
FIG. 1A is a front elevational view of a wall with a french door therein and the lighted curtain hardware assembly of the present invention.

Referring to FIGS. 1 and 1A, the invention comprised of a lighted curtain hardware assembly 10 maybe seen. The hardware device assembly 10 generally comprises curtain support hardware 18 comprised of either curtain rod 20 or tie backs 80. The hardware 18 supports glass globes 32 with light bulbs 66. Electricity to the hardware assembly is supplied from the electrical wall outlet 8 commonly found on wall 4.

More specifically, residences commonly have walls 4 with windows 6 or doors 7 therein. Also found on walls 4 are wall outlets 8 which commonly provides 110 V alternating current for providing electricity to appliances, lights and other electrical and electronic equipment commonly found in most residences. Window 6 (or door 7) commonly has a top frame 12 and a side frame 14. As stated in the background and apart from soft-looking window treatments of which the present invention is a derivation, window 6 (or door 7) may also have a hard-look window treatment such as slat blinds 16 or the like.

Figure 2:
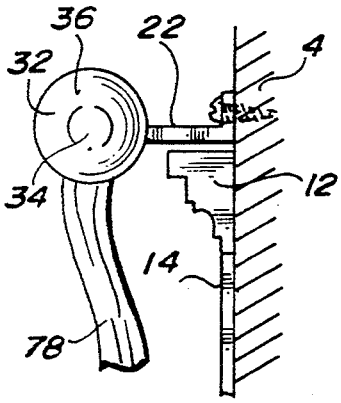
FIG. 2 is an end view taken along lines 2—2 of FIG. 1 showing the invention.

The lighted curtain hardware assembly 10 of the present invention includes a curtain rod 20 suitably made from a 2" diameter cylindrical brushed or polished brass, platinum or other desirable colored or treated metal or durable material. The curtain rod 20 is intended to give a rich stylish "jewelry for the home" look. The curtain rod 20 is supported by wall 4 by way of a bracket 22, as clearly seen in FIG. 2, just above the top frame 12 of window 6. Bracket 22 may be affixed to rod 20 suitably by spot welding or a collar-type clamp being fastened to rod 20 as would be apparent to those of ordinary skill in the art.

Referring to FIGS. 1, 2, 5 and 6, the assembly of the curtain rod 20 and the other elements of the lighted curtain hardware assembly 10 may be appreciated. The curtain rod 20 suitably has a hollow interior 24 with open ends 26. Along the curtain rod 20 in a position that will not readily be seen by the casual observer is located a small aperture or hole 28 which is protected by a grommet 30 as to not have any sharp edges.

Decorative glass globes, bulbs or finials 32 are utilized with the invention. The globes or finials 32 have any of a variety of artistic texturing, coloring or frosting as the globes 32 are commonly hand-blown as shown in FIGS. 1, 5 and 8–10. The glass globes 32 commonly will have a peak 34, an enlarged base portion 36 and a mounting neck 38 with an opening 40 thereat leading into the hollow interior 42 of the globe or finial 32.

Expandable and contractible cylindrical connectors 44, typically made out of plastic, are utilized with the invention. The connectors 44 provide the means for attaching the globes 32 to the open ends 26 of the current rod 20. The connectors 44 have a cut out channel 46 which permits the connectors to expand or contract as to fit about the mounting necks 38 of any particular globe 32 and to slide into an open end 26. The connectors 44 also suitably have a bevelled end 48 to assist in guiding the connectors 44 into one of the open ends 26 for a sturdy friction fit. The connectors 44 also have opposing apertures 50 therein as will be appreciated below.

Light brackets 52 are provided for the present invention and appropriately are made of metal of a general flat u-shape. Brackets 52 have wings or extensions 54 with apertures 56 therethrough which are alignable with connector holes 50 for securing the brackets 52 to, and partially within, the bevelled end of connectors 44 and secured thereat by sheet metal screws 57 passing through holes 50 and 56. The brackets 52 each have a base 58 with an aperture (not shown) therein whereat light socket 60 is mounted and threaded mounting end 62 passes therethrough. A nut 64 is threadable onto the mounting end 62 for securing the socket 60 at base 58 and between wings or extensions 54. A light bulb 66 is appropriately screwed into socket 60. Light bulb 66 appropriately may be approximately seven watts such as a christmas tree light bulb. Lines or wires 68 extend from socket 60 and from the bottom of base 58 into curtain rod interior 24 wherein they are covered by cord 70 which passes through the small aperture 28 of curtain rod 20 which is protected by grommet 30 as to not cut cord 70.

Figure 5:
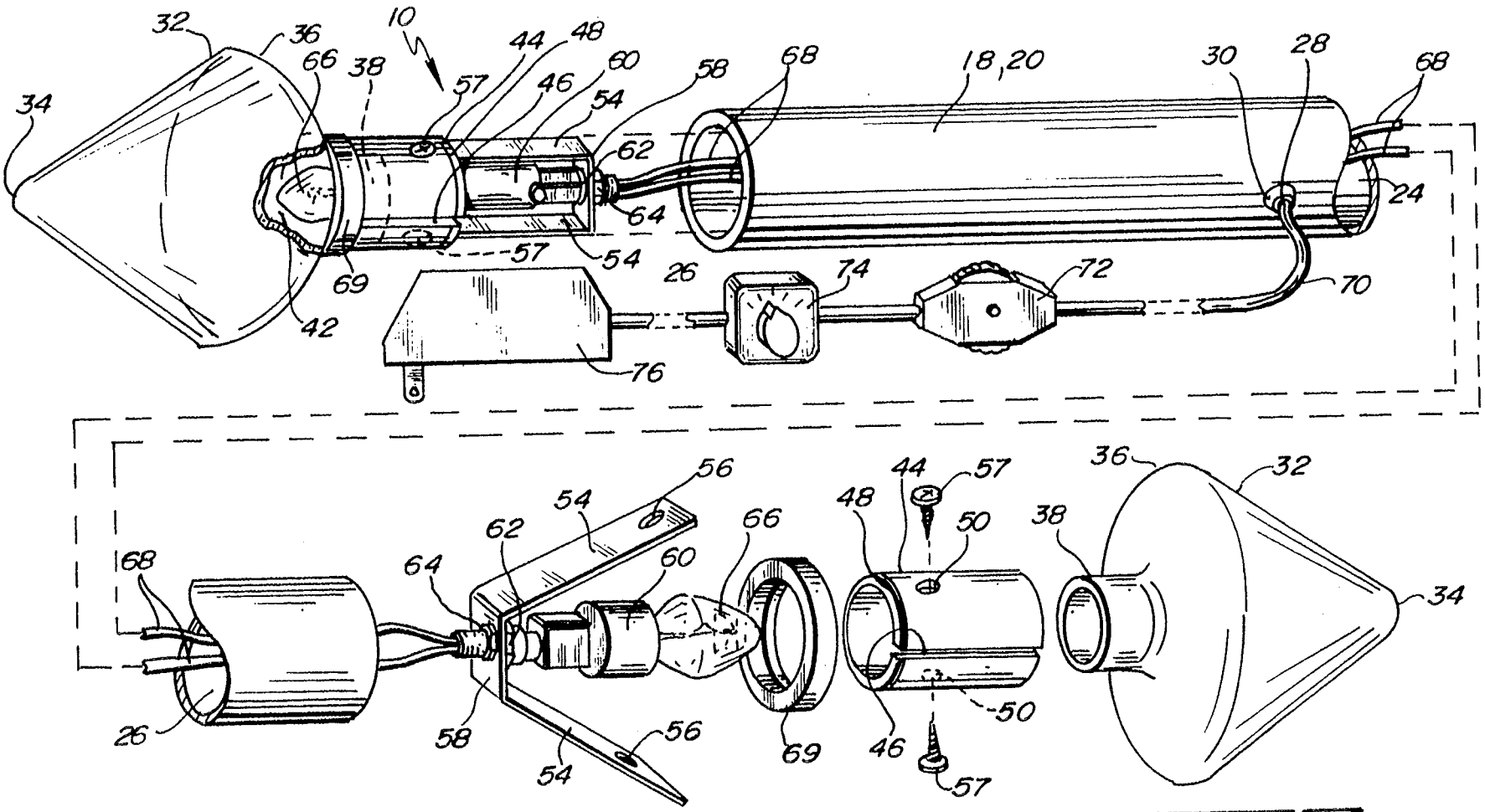
FIG. 5 is an exploded front elevational view of the hardware assembly.

As the assembly is put together shown in FIG. 5, a collar 69 is used lending an ornamental finish to the curtain support hardware 18. The collar 69 is slid over the connector 44 before the wires 68 are inserted into curtain rod 20. Collar 69 ornamentally covers up the union of the connector 44 and the mounting neck 38 of the globe 32 to give an attractive finished look.

Figure 7:
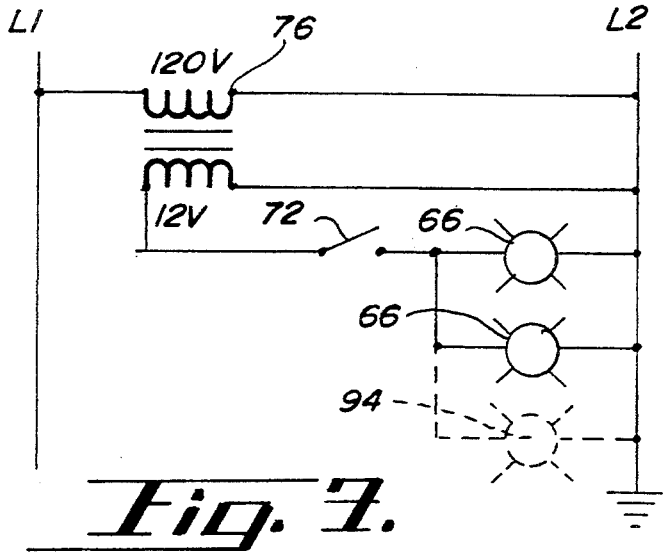
FIG. 7 is an electrical schematic of the electrical means of the assembly.
Figure 8:
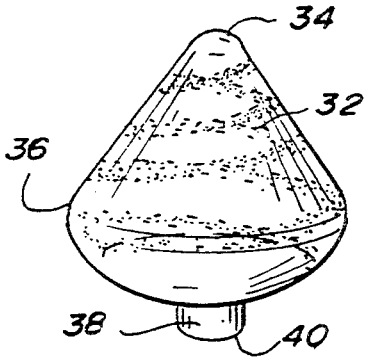
FIG. 8 is a front elevational view of a decorative glass globe operable with the invention.

Referring to FIGS. 1, 5 and 7, the electrical means, which provides electricity to the hardware assembly 10, may be observed. As the cord 70 exits the curtain rod 20, it extends downwardly along the wall 4 and is hidden by the curtain, drape or fabric material 78 until it reaches near the floor and is connected to a step-down transformer 76. Along cord 70 may also be located a switch 72 for turning the lights 66 on and off. A rheostat 74 may also be placed in line for adjusting the light intensity of light bulbs 66 for the desired mood of the resident. Step-down transformer 76 appropriately has an input of 120 V 60 Hz 50 watts with an output of 10 V.A.C. at 1.0 amps. Transformer 76 appropriately has a plug for fitting into the electrical wall outlet 8 which commonly supplies 110 V alternating current to the residence.

The drape, curtain or fabric material 78 may then be draped over the curtain rod 20 in any of a multiplicity of arrangements. The intended purpose is an extremely simply soft-look uncomplicated by traditional curtain, traverse or drapery rods. The drape 78 appropriately hides the cord 70 as it trails downwardly towards the outlet 8.

Figure 3:
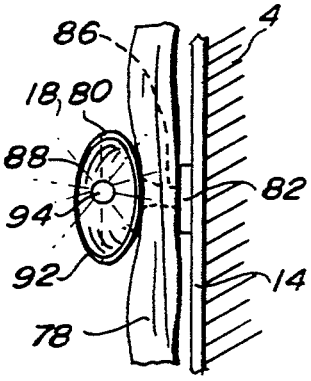
FIG. 3 is an end view of the invention taken along lines 3—3 of FIG. 1.
Figure 9:
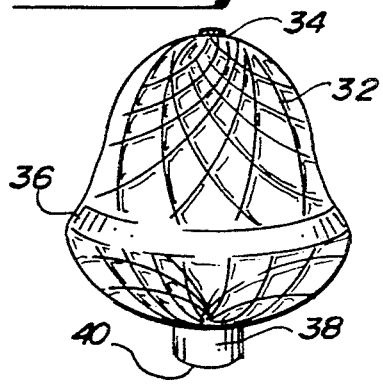
FIG. 9 is a front elevational view of another embodiment of a decorative glass globe usable with the present invention.
Figure 6:
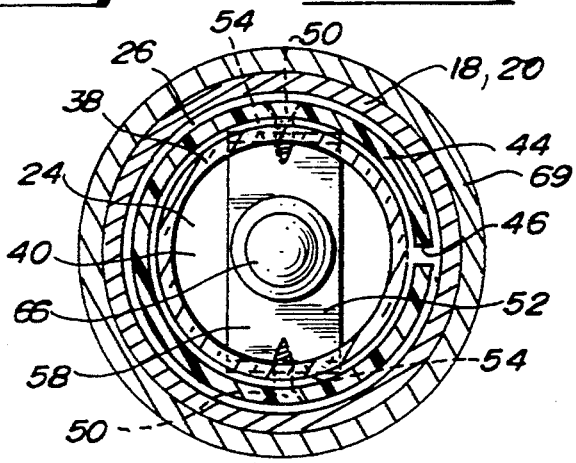
FIG. 6 is a cross-sectional view through the hardware assembly taken along lines 6—6 of FIG. 1.
Figure 10:
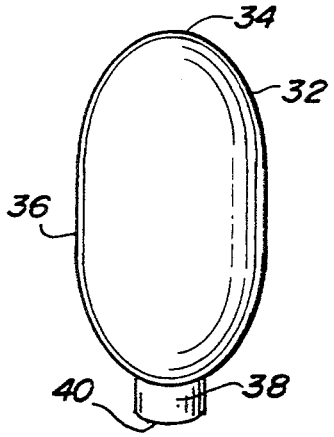
FIG. 10 is yet another embodiment of a decorative glass globe for use with the invention.
Figure 4:
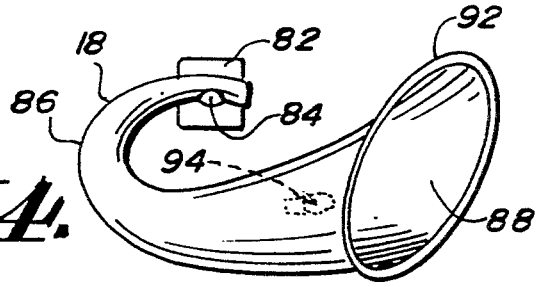
FIG. 4 is a perspective view of one embodiment of the invention similar to FIG. 3.

Referring to FIGS. 1, 3 and 4, another embodiment of the curtain support hardware 18 may be seen in the form of a lighted curtain tie back 80. The tie back 80 suitably has a wall mount base 82 for affixing the tie back 80 to the wall 4 adjacent the side frame 14 of window 6 by way of screws or the like passing through aperture 84 of base 82 in wall 4. Extending from base 82 is an arcuate drape hold or tie back portion 86 which comes around the front of drape 78 forming an ornamental face 88. The face 88 may take a variety of appearances such as a sun 90 or a lily flower 92. Light bulb 94 is appropriately mounted adjacent or behind the ornamental face 88, such as behind sun 90 or within the lily flower 92. The electrical components for lighted curtain tie backs 80 are in line with the electrical components of the curtain rod assembly 20 as schematically shown in FIG. 7.

The lighted curtain tie backs 80 are desirable with a more full curtain 78. The effect is that the tie backs 80 pull the curtains 78 a ways from obstructing the view of window 6 and to add a lighted swag look.

The present invention may be embodied in other specific forms without departing from the spirit or essential attributes thereof; therefore, the illustrated embodiment should be considered in all respects as illustrative and not restrictive, reference being made to the appended claims rather than to the forgoing description to indicate the scope of the invention.

What is claimed:

1. A lighted curtain hardware assembly for a wall having an opening therein comprising:

a) a rod mountable adjacent the opening for supporting a curtain in front of, adjacent and away from the opening as to not obstruct a view through the opening having two opposing ends, wherein the rod is hollow with the two ends being open, the rod being adapted for suspending a curtain therefrom;

b) first and second lights mounted on the ends of the rod;

c) electrical means for providing electricity to the lights;

d) two decorative glass globes each adapted to be received and held at one open end; and e) two connectors, each adapted to be slidably mounted in one of the open ends, to clamp onto a mounting neck of one of the globes and to support one of the lights in proximity of the neck of one of the globes.

2. The lighted curtain hardware assembly of claim 1 wherein the electrical means includes a step down transformer for supplying low voltage to the light.

3. The lighted curtain hardware assembly of claim 1 wherein the connectors are expandable and contractible to fit over the necks and to fit into the open ends.

4. The lighted curtain hardware assembly of claim 1 wherein the connectors each has a light bracket connected to an inside of the connector to support the light.

5. The lighted curtain hardware assembly of claim 1 wherein the opening is a window.

6. The lighted curtain hardware assembly of claim 1 wherein the opening is a door.

7. A light curtain hardware assembly for a wall having an opening therein, comprising:

a) a curtain support hardware device mountable adjacent the opening for supporting a curtain in front of, adjacent and away from the opening as to not obstruct a view through the opening, comprising a hollow rod mountable on the wall above the opening with two opposing open ends, the rod being adapted for suspending a curtain therefrom;

b) a light mounted at each open end;

c) electrical means with a step down transformer for providing low voltage electricity to the light to provide an attractive lighted decoration to the opening and the wall;

d) two decorative glass globes each adapted to be received and held at one open end; and e) two connectors, each adapted to be slidably mounted in one of the open ends, to clamp onto a mounting neck of one of the globes and to support one of the lights in proximity of the neck of one of the globes.

8. The lighted curtain hardware assembly of claim 7 wherein the connectors are expandable and contractible to fit over the necks and to fit into the open ends.

9. The lighted curtain hardware assembly of claim 7 wherein the connectors each has a light bracket connected to an inside of the connector to support the light.

10. The lighted curtain hardware assembly of claim 7 wherein the opening is a window.

11. The lighted curtain hardware assembly of claim 7 wherein the opening is a door.

12. A lighted curtain hardware assembly for a wall having a window therein, comprising:

a) a substantially hollow rod mountable on the wall above the window with two opposing open ends, the rod being adapted for suspending a curtain therefrom;

b) two decorative glass globes each adapted to be grasped by a connector, each connector having a bracket for supporting a light and each connector being adapted to be slidably mounted in one of the open ends of the rod;

c) electrical means with a step down transformer for providing low voltage electricity to the lights.

13. The lighted curtain hardware assembly of claim 12 wherein the glass globes each have a mounting neck.

14. The lighted curtain hardware assembly of claim 13 wherein each connector is adapted to clamp onto a mounting neck of one of the globes and to support one of the bracket and light in proximity of the neck of one of the globes.

15. The lighted curtain hardware assembly of claim 14 wherein the connectors are expandable and contractible to fit over the necks and to fit into the open ends.

16. The lighted curtain hardware assembly of claim 14 wherein the connectors each has the light bracket connected to an inside of the connector to support the light.

* * * * *